United States Patent [19]

Winkler et al.

[11] Patent Number: 4,489,639

[45] Date of Patent: Dec. 25, 1984

[54] ARMOR CAR-MOUNTED MORTAR

[75] Inventors: Gert Winkler, Meerbusch; Wilfried Becker, Düsseldorf; Erich Zielinski, Haan; Herbert Lipp, Düsseldorf, all of Fed. Rep. of Germany

[73] Assignee: Rheinmetall GmbH, Düsseldorf, Fed. Rep. of Germany

[21] Appl. No.: 385,006

[22] Filed: Jun. 3, 1982

[30] Foreign Application Priority Data

Jun. 3, 1981 [DE] Fed. Rep. of Germany ..... 3121963

[51] Int. Cl.[3] ..... F41F 1/06

[52] U.S. Cl. ..... 89/46; 89/37 K; 89/40 A; 89/43 R

[58] Field of Search ..... 89/1 F, 1 J, 37 L, 37 K, 89/40 A, 43 R, 46

[56] References Cited

U.S. PATENT DOCUMENTS

| | | | |
|---|---|---|---|
| 2,442,371 | 6/1948 | Meyers et al. | 89/43 R |
| 2,643,582 | 6/1953 | Healy | 89/40 A |
| 2,715,856 | 8/1955 | Kramer et al. | 89/43 R |
| 2,922,338 | 1/1960 | Barbe | 89/1 F |
| 3,608,422 | 9/1971 | Bretnor . | |
| 4,012,986 | 3/1977 | Germershausen et al. | 89/37 C |

FOREIGN PATENT DOCUMENTS

| | | | |
|---|---|---|---|
| 728266 | 11/1942 | Fed. Rep. of Germany | 89/46 |
| 2260003 | 6/1973 | Fed. Rep. of Germany . | |
| 1135201 | 4/1957 | France | 89/40 A |
| 1269185 | 7/1961 | France | 89/37 C |
| 1259462 | 1/1972 | United Kingdom | 89/37 K |

*Primary Examiner*—Stephen C. Bentley
*Attorney, Agent, or Firm*—Spencer & Frank

[57] ABSTRACT

A muzzle loading mortar constructed for mounting on a protected enclosure, for example, an armored vehicle. The mortar includes a mortar tube having an open end for receiving and discharging a projectile, and mounting means, including a tube cradle connected with a recoil-return means, are provided for mounting the tube on the enclosure. The recoil-return means includes a hydraulic member which cooperates with a spring for reducing the forces introduced into the enclosure during development of a shot from the mortar. A loading means is mounted for relative movement between the open end of the tube and the protected enclosure for muzzle loading the open end of the tube with a projectile. The loading means can be operated from within the protected enclosure to load a projectile into the mortar tube.

16 Claims, 3 Drawing Figures

10
11
12
14
16
18
20
22
24
26
28
29
30
32
34
36
38
40
42
44
46
48
50
52
54
56
58
60
62
64
90
100
A
V
R
L1
L2

ARMOR CAR-MOUNTED MORTAR

BACKGROUND OF THE INVENTION

The invention relates to a mortar mounted on a carrier vehicle, preferably of the armored type, wherein the recoil-return device of the mortar is integrated into the mortar's tube cradle.

A mortar of the above-mentioned type is known from German Offenlegungsschrift No. 2,260,003, which relates to a mortar designed as a breech-loaded weapon on a light-weight carrier vehicle. The mortar is mounted on a rotary ring and is provided with an annular spring as the recoil-return device which encloses its tube over a given length.

This known arrangement has a few drawbacks. Initially, the design of the mortar as a breech-loaded weapon involves considerable structural expenditures, particularly in that region of the arrangement which is subject to the greatest stress. Additionally, an annular spring is able to handle only a relatively short return path. Consequently, if the weapon is mounted on a light-weight carrier vehicle, the caliber of the mortar has an annoying upper limit. Since the caliber essentially influences the recoil forces, if these recoil forces become too large, they lead to overstress on the annular spring with heavy surge-type stresses on the entire carrier with all the drawbacks involved therein. The caliber of the mortar according to the known arrangement must therefore not exceed a low maximum dimension. However, this limits the fire power in an annoying manner with respect to range as well as with respect to the damage effect of each individual shot.

SUMMARY OF THE INVENTION

It is an object of the invention to provide a mortar of the above described type which can be operated from the cover afforded by a carrier vehicle, which is distinguished by simplicity, particularly in the part under the greatest stress, i.e. the tube, and which assures sufficient fire power even if mounted on a light-weight carrier vehicle.

The above and other objects are accomplished by the invention wherein a muzzle loading mortar is mounted on a protected enclosure. The mortar includes a mortar tube having an open end for receiving and discharging a projectile, and mounting means, including a tube cradle connected with a recoil-return means, are provided for mounting the tube on the enclosure. The recoil-return means includes a hydraulic member which cooperates with a spring for reducing the forces introduced into the enclosure during development of a shot from the mortar. A loading means is mounted for relative movement between the open end of the tube and the protected enclosure for muzzle loading the open end of the tube with a projectile. The loading means can be operated from within the protected enclosure to load a projectile into the mortar tube.

The invention will be explained in greater detail below with the aid of two preferred embodiments which are illustrated in the drawings in an essentially schematic representation in which details not of significance for the invention have been omitted.

DESCRIPTION OF THE PREFERRED EMBODIMENT

Figure 1:
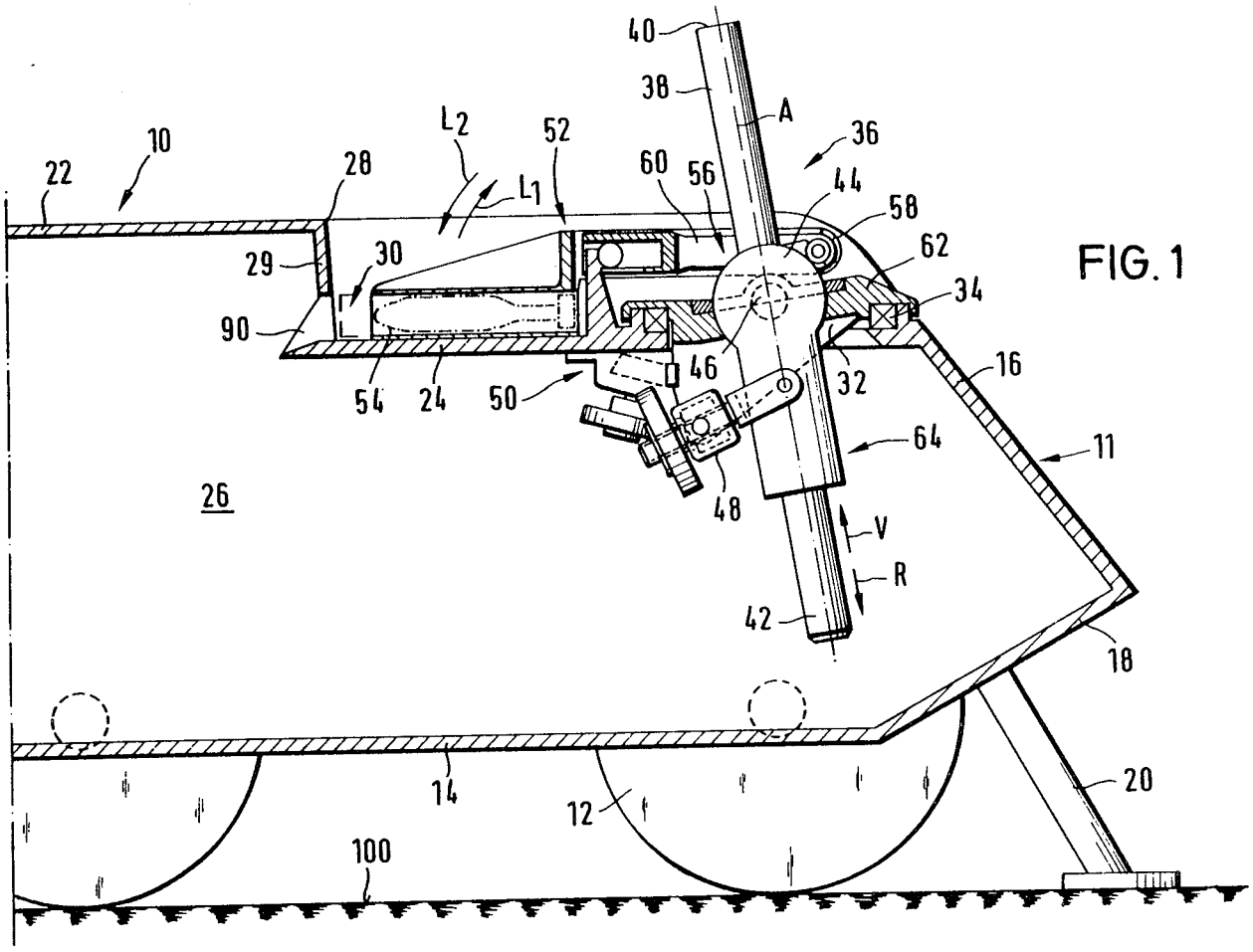
FIG. 1 is a side elevational view in partial cross-section showing a first embodiment, according to the invention, with a loading device which is pivotal on a carrier vehicle with respect to the mortar tube.
Figure 3:
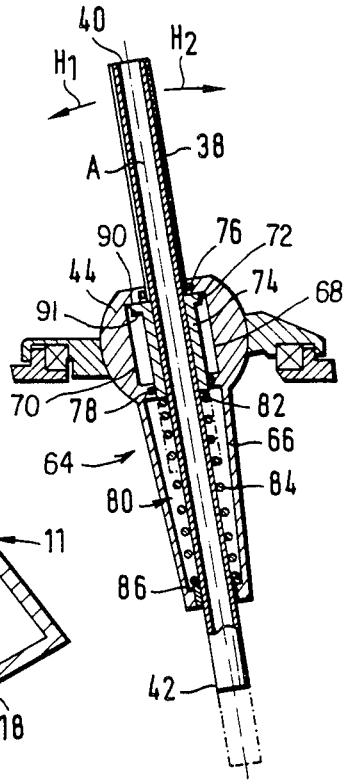
FIG. 3 is a longitudinal, axial, cross-sectional view of the mortar of FIG. 2 without the loading device.

According to FIG. 1, a carrier vehicle 10 with wheels 12 comprises a bottom 14, exterior walls 16 and 18 and a cover 22 and 24, all of which is conventional for armored vehicles. The interior 26 is designed, in a manner not shown, to accommodate crew and ammunition. The cover 22 is bent at 28 and changes from an apron 29 to part 24 which, at the level of a top edge (not identified in detail) of the exterior wall 16, is disposed in the tail region 11 of the carrier vehicle 10. A bearing opening 32 provided between 24 and 26 includes a ring gear 34 for coacting with a rotary platform 62. In a manner not shown in detail, a mortar 36 is mounted in the rotary platform 62 via pinions 46 and a cradle roll 44. The elevation adjusting device 48 and the traversing device 50 are operated from the interior 26. A ball joint 58 is provided at the cradle roll 44 as the bearing for a load manipulator 52 which is designed in the form of a rocker. It has two arms of which only one, 60, is shown. The arms are joined at their one end to form a double socket (not shown) for the ball joint 58 and at their other end, they are provided with a projectile receptacle 54. In the illustrated state, the load manipulator 52 is guided in such a manner that, together with the projectile receptacle 54, it lies in a depression 30 of the cover 24, obliquely below the apron 29. In this position, the extended axis (not shown in detail) of the projectile receptacle 54 is oriented toward a loading opening 90 below apron 29. A loading drive 56, which is indicated symbolically only, permits movement of the load manipulator 52 from the illustrated position in the direction of the arrow $L_1$ into each of the positions adapted to the respective position of tube 38, in which the axis of the projectile receptacle 54 is flush with the bore axis A of the tube. In this way it is advantageously assured that the mortar 36 can be operated in combat from the cover afforded by the interior 26. For the purpose of loading, the load manipulator 52 is pivoted in the direction of the arrow $L_2$ into the illustrated position. A projectile (not shown) is introduced from the interior 26 through the loading opening 90 into the projectile receptacle 54 and is there fixed by means of a releasable clamping device. Then the load manipulator 52 is pivoted in the direction of the arrow $L_1$ until the axis of the projectile receptacle 54 is flush with the bore axis A of the tube. By releasing actuation of the clamping device the projectile is caused to fall into the tube 38 of the mortar 36 whereupon the load manipulator 52 is immediately pivoted again in the direction of arrow $L_2$ so as not to interfere with the projectile leaving the muzzle 40 of tube 38. During development of the shot, the tube 38 moves back in the direction of arrow R. This causes a recoil-return device 64 to become effective, which is shown in FIG. 3 and will be described in detail below. This device makes it possible to manage a long return path so that the forces introduced into the carrier vehicle 10 are kept within realistic limits. In this way, high fire power is assured with respect to range and damage effect—both being essentially dependent on the tube caliber and the size of the charge.

Figure 2:
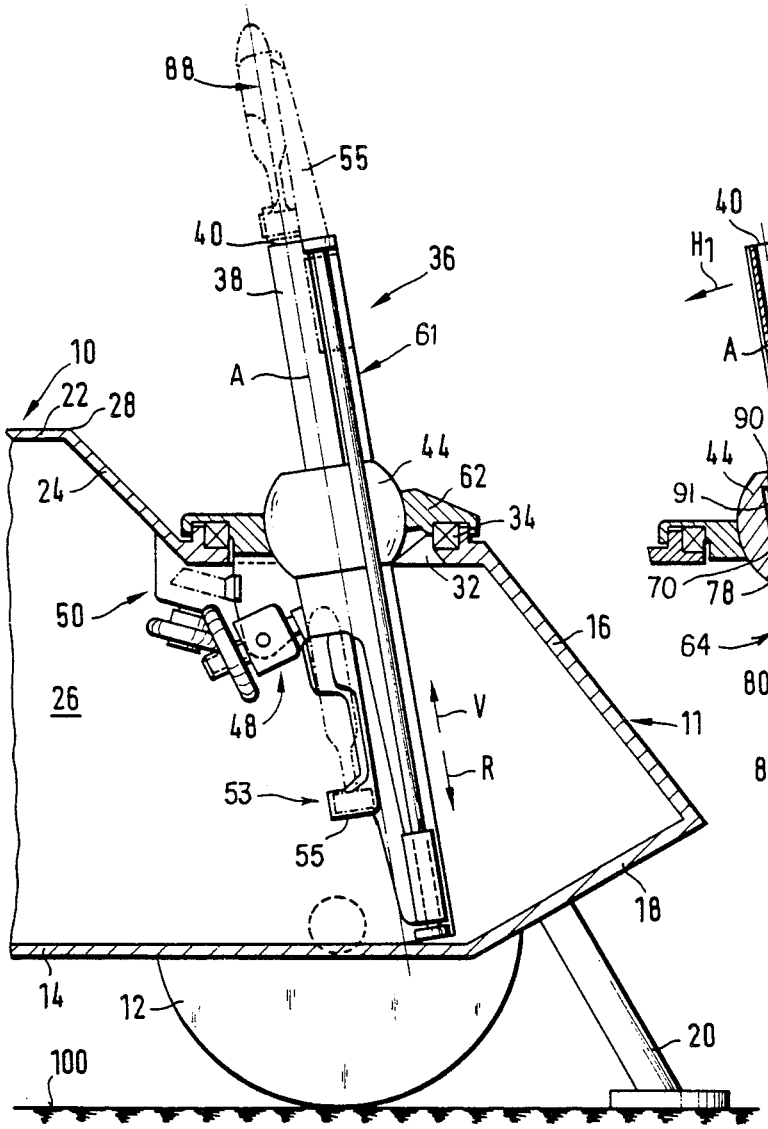
FIG. 2 is a side elevatonal view in partial cross-section of a second embodiment according to the invention with a loading device arranged alongside the mortar tube.

The embodiment of FIG. 2 differs from the above-described embodiment mainly by the type of load manipulator 53 and thus by the manner of loading the mortar 36. The load manipulator 53 includes a rod assembly 61 which is disposed at the tube 38 in such a manner that a projectile receptacle 55 can be moved up and down along the rod assembly 61 in the direction of arrows V and R. For this purpose, a passage opening (not shown) is provided in the rotary platform 62. The rod assembly 61 follows every adjustment movement of tube 38, with the lower end (not identified in detail) of the tube always remaining in the interior 26. A projectile 88 is releasably fixed in the projectile receptacle 55 in a lower loading position. Then the projectile receptacle 55 moves upwardly in the direction of arrow V and is pivoted over the muzzle 40 of the tube 38 so that it is flush with the bore axis A of the tube. By releasing actuation of the clamping device (not shown) the projectile 88 is enabled to fall into the tube 38, whereupon the projectile receptacle 55 is immediately pivoted back so as to not interfere with the projectile 88 leaving the muzzle 40.

With the aid of FIG. 3, the recoil-return device 64 will now be described. The latter is designed, in the region of the cradle roll 44, as a hydraulic member 68 including a cylinder 70 filled with hydraulic fluid. The upper part of cylinder 70 is provided with a seal 76 and the lower part with a seal 78. The flange 72 at the upper side of a jacket 74 placed around tube 68 is provided with an upper piston face 90 and with a lower piston face 91. A choke valve (not shown) is disposed in flange 72. At its underside, the jacket 74 is delimited by a collar designed as spring abutment 82 for a compression spring 84. The spring 84 encloses the tube 38 below cylinder 70 and is part of a mechanical member 80 of the recoil-return device 64. The mechanical member 80 is provided with a housing 66 whose upper end is connected with the cradle roll 44 and whose lower end is provided with a lower spring abutment 86 for spring 84. The recoil-return device 64 constitutes the advantageous transfer of a principle proven in connection with breech-loaded tubular weapons, for example cannons, to use with a mortar. Due to the combination of a mechanical member with a hydraulic member, as represented by members 80 and 68, the recoil-return device 64 is able to master long return paths and thus avoids annoying power peaks at the pinions as do the above-mentioned weapons. This indicates that the invention makes it possible to use large caliber steep fire weapons when mounted on comparatively light-weight carrier vehicles. These may be wheeled as well as chain driven vehicles, and a limitation to a certain area of the carrier vehicle, for example, the center of the vehicle, is advantageously eliminated. For reasons of additional safety, on very light-weight wheeled vehicles, as indicated in FIGS. 1 and 2, a support 20 may be provided, for example in a telescoping design, to be effective between the carrier vehicle 10 and the bottom surface 100. Due to good damping realized by the recoil-return device according to the invention, mounting according to the principle of cardanic suspension also becomes a reality. The consequent reduction of the conventional turret to a rotary platform, in connection with the good damping, also permits mounting of the weapon on the exterior of the vehicle where a base plate for the direct introduction of the recoil forces into the ground is then not necessary. The consequent transfer of the muzzle-loading principle requires exclusive use in the upper angle group since a given falling rate is required for the projectile when it drops into the tube, which falling rate can be realized only if the tube has the sufficient length and there is not much friction between projectile and the interior walls of the tube. This feature coexists with the already mentioned high fire power; the leight-weight mount not only favors maneuverability of the carrier vehicle even in unwieldy terrain, but also—if designed accordingly—its floating capability. Finally, the muzzle-loaded mortar according to the invention permits manual emergency operation, without curtailing fire power, which, since such emergency operation is limited in time in any case, justifies a temporary and also only partial restriction of protection from case to case. Since with the mortar according to the invention all types of discharge means known for muzzle-loaded weapons in the upper angle group can be used and these are not considered to be significant for the invention in the present case, detailed discussion thereof is not necessary here.

We claim:

1. A muzzle loading mortar arrangement forming a combination with a protected enclosure having an upper cover, said combination comprising:

a mortar tube having an open end for receiving and discharging a projectile, said mortar tube having a bore axis;

loading means mounted for relative movement between the open end of said mortar tube and said protected enclosure for muzzle loading the open end of said mortar tube with the projectile;

a rotatable platform defining a lateral plane and being mounted in said upper cover; and a cradle roll connected to and enclosing said mortar tube, said cradle roll including a recoil-return means for reducing the forces introduced into said protected enclosure during development of a shot from said mortar tube, said cradle roll being mounted in said rotatable platform so that the mortar tube passes through said rotatable platform and is pivotable, along with said cradle roll, about a horizontal axis which extends in close proximity to the lateral plane of said rotatable platform.

2. The combination according to claim 1, wherein the upper cover of said protected enclosure defines a bearing opening which is covered by said rotatable platform and additionally including a ring gear surrounding said bearing opening and coacting with said rotatable platform to effect rotation of said rotatable platform.

3. The combination according to claim 1, and additionally including traversing means connected to said rotatable platform for causing said rotatable platform to traverse a desired angle in said lateral plane.

4. The combination according to claim 1, and additionally including an elevation adjustment means connected to said cradle roll for moving said mortar tube about said horizontal axis to adjust the elevation of said mortar tube.

5. The combination according to claim 1, wherein said loading means is operable from within said protected enclosure.

6. The combination according to claim 1, wherein said recoil-return means includes a hydraulic member and a spring cooperating with said hydraulic member.

7. The combination according to claim 6, wherein said cradle roll includes a recess in which said hydraulic member is disposed, said hydraulic member includes a piston having a throughbore, and said mortar tube is disposed in said throughbore and fixed to said piston.

8. The combination according to claim 7, wherein said piston presents an abutment facing the bottom of said mortar tube, said spring is concentrically disposed around said mortar tube between the bottom of said mortar tube and said cradle roll with the end of said spring adjacent said cradle roll being in contact with said piston abutment, and further including a lower abutment for supporting the end of said spring adjacent the bottom of said mortar tube.

9. The combination according to claim 1, wherein said upper cover plate defines a loading opening through which a projectile can be passed from the interior to the exterior of said protected enclosure.

10. The combination according to claim 9, wherein said loading means is articulated to said cradle roll for relative movement between the open end of said mortar tube and the loading opening of said protected enclosure.

11. The combination according to claim 9, wherein said loading opening and said lateral plane are at substantially the same height.

12. The combination according to claim 1, wherein said loading means includes a projectile receptacle that is movable with respect to said mortar tube and the protected enclosure, said receptacle being movable into a given spatial relationship with the interior of the said protected enclosure for receiving a projectile from the interior of said protected enclosure.

13. The combination according to claim 12, wherein said protected enclosure is provided with a loading opening through which a projectile can be passed and said loading means further includes: a ball joint via which said receptacle is articulated to said cradle roll; said receptacle being pivotable about said ball joint between the end of said tube and a receiving position at which said receptacle is aligned with said opening for receiving a projectile passed therethrough; and a loading drive means for causing said receptacle to pivot between said receiving position and a position that is aligned with the bore axis of said mortar tube.

14. A mortar according to claim 12, wherein said loading means further includes a rod assembly extending substantially over the length of said tube and means mounting said receptacle on said rod assembly for movement along the length of said tube.

15. The combination according to claim 1, wherein at least part of said mortar tube extends into the interior of said protected enclosure.

16. The combination according to claim 1, wherein said protected enclosure is an armored carrier vehicle.

* * * * *